US008941457B2

(12) United States Patent
Yan et al.

(10) Patent No.: US 8,941,457 B2
(45) Date of Patent: Jan. 27, 2015

(54) MINIATURE POWER INDUCTOR AND METHODS OF MANUFACTURE

(75) Inventors: Yipeng Yan, Shanghai (CN); Robert James Bogert, Lake Worth, FL (US); Daniel Minas Manoukian, San Ramon, CA (US)

(73) Assignee: Cooper Technologies Company, Houston, TX (US)

( * ) Notice: Subject to any disclaimer, the term of this patent is extended or adjusted under 35 U.S.C. 154(b) by 222 days.

(21) Appl. No.: 12/766,314

(22) Filed: Apr. 23, 2010

(65) Prior Publication Data

US 2010/0259352 A1 Oct. 14, 2010

Related U.S. Application Data

(63) Continuation-in-part of application No. 12/181,436, filed on Jul. 29, 2008, which is a continuation-in-part of application No. 11/519,349, filed on Sep. 12, 2006.

(51) Int. Cl.
*H01F 5/00* (2006.01)

(52) U.S. Cl.
USPC ..... 336/200

(58) Field of Classification Search
USPC ..... 336/65, 83, 200, 206–208, 232–234
See application file for complete search history.

(56) References Cited

U.S. PATENT DOCUMENTS

| | | | |
|---|---|---|---|
| 2,391,563 | A | 12/1945 | Goldberg |
| 3,255,512 | A | 6/1966 | Lochner et al. |
| 4,072,780 | A | 2/1978 | Zillman |
| 4,313,152 | A | 1/1982 | Vranken |
| 4,322,698 | A | 3/1982 | Takahashi et al. |
| 4,498,067 | A | 2/1985 | Kumokawa et al. |
| 4,543,553 | A | 9/1985 | Mandai et al. |
| 4,689,594 | A | 8/1987 | Kawabata et al. |
| 4,750,077 | A | 6/1988 | Amagasa |
| 4,758,808 | A | 7/1988 | Sasaki et al. |
| 4,803,425 | A | 2/1989 | Swanberg |
| 4,873,757 | A | 10/1989 | Williams |
| 5,032,815 | A | 7/1991 | Kobayashi et al. |
| 5,045,380 | A | 9/1991 | Kobayashi et al. |
| 5,142,767 | A | 9/1992 | Adams et al. |
| 5,197,170 | A | 3/1993 | Senda et al. |
| 5,250,923 | A | 10/1993 | Ushiro et al. |
| 5,257,000 | A | 10/1993 | Billings et al. |

(Continued)

FOREIGN PATENT DOCUMENTS

| | | |
|---|---|---|
| DE | 8132269 | 1/1986 |
| DE | 102005039379 A1 | 3/2007 |

(Continued)

OTHER PUBLICATIONS

EMI Suppression Sheets (PE Series); http://www.fdk.com.jp; 1 page, no date, no month, no year.

(Continued)

*Primary Examiner* — Tuyen Nguyen
(74) *Attorney, Agent, or Firm* — Armstrong Teasdale LLP

(57) ABSTRACT

Magnetic components such as power inductors for circuit board applications include pressure laminate constructions involving flexible dielectric sheets that may integrally include magnetic powder materials. The dielectric sheets may be pressure laminated around a coil winding in an economical and reliable manner, with performance advantages over known magnetic component constructions.

22 Claims, 4 Drawing Sheets

(56) References Cited

U.S. PATENT DOCUMENTS 5,300,911 A 4/1994 Walters
5,463,717 A 10/1995 Takatori et al.
5,500,629 A 3/1996 Meyer
5,515,022 A 5/1996 Tashiro et al.
5,532,667 A 7/1996 Haertling et al.
5,572,180 A 11/1996 Huang et al.
5,574,470 A 11/1996 de Vall
5,598,136 A * 1/1997 Kano et al. ..... 336/200
5,631,822 A 5/1997 Silberkleit et al.
5,664,069 A 9/1997 Takatori et al.
5,761,791 A 6/1998 Bando
5,801,521 A * 9/1998 Mizoguchi et al. ..... 323/282
5,821,638 A 10/1998 Boys et al.
5,828,940 A 10/1998 Learman
5,849,355 A 12/1998 McHenry
5,875,541 A 3/1999 Kumeji et al.
5,896,078 A 4/1999 Hayakawa et al.
5,912,609 A 6/1999 Usui et al.
5,945,902 A 8/1999 Lipkes et al.
6,038,134 A 3/2000 Belter
6,054,914 A 4/2000 Abel et al.
6,107,907 A 8/2000 Leigh et al.
6,114,939 A 9/2000 Wittenbreder
6,169,801 B1 1/2001 Levasseur et al.
6,198,374 B1 3/2001 Abel
6,198,375 B1 3/2001 Shafer
6,204,744 B1 3/2001 Shafer et al.
6,287,931 B1 9/2001 Chen
6,293,001 B1 9/2001 Uriu et al.
6,366,192 B2 4/2002 Person et al.
6,379,579 B1 4/2002 Harada
6,392,525 B1 * 5/2002 Kato et al. ..... 336/233
6,420,953 B1 7/2002 Dadafshar
6,449,829 B1 9/2002 Shafer
6,460,244 B1 10/2002 Shafer et al.
6,522,549 B2 2/2003 Kano et al.
6,566,731 B2 5/2003 Ahn et al.
6,628,531 B2 9/2003 Dadafshar
6,631,545 B1 10/2003 Uriu et al.
6,653,196 B2 11/2003 Ahn et al.
6,658,724 B2 12/2003 Nakano et al.
6,710,692 B2 3/2004 Kato et al.
6,713,162 B2 3/2004 Takaya et al.
6,720,074 B2 4/2004 Xiao et al.
6,749,827 B2 6/2004 Smalley et al.
6,750,723 B2 6/2004 Yoshida et al.
6,791,445 B2 9/2004 Shibata et al.
6,794,052 B2 9/2004 Schultz et al.
6,797,336 B2 9/2004 Garvey et al.
6,808,642 B2 10/2004 Takaya et al.
6,817,085 B2 11/2004 Uchikoba et al.
6,835,889 B2 12/2004 Hiraoka et al.
6,859,130 B2 2/2005 Nakashima et al.
6,864,201 B2 3/2005 Schultz et al.
6,879,238 B2 4/2005 Liu et al.
6,882,261 B2 4/2005 Moro et al.
6,885,276 B2 4/2005 Iha et al.
6,888,435 B2 * 5/2005 Inoue et al. ..... 336/83
6,897,718 B2 5/2005 Yoshida et al.
6,903,641 B2 6/2005 Kondo et al.
6,903,945 B2 * 6/2005 Kitano ..... 363/21.01
6,908,960 B2 6/2005 Takaya et al.
6,924,777 B2 8/2005 Reasoner et al.
6,927,738 B2 8/2005 Senba et al.
6,936,233 B2 8/2005 Smalley et al.
6,946,944 B2 9/2005 Shafer et al.
6,949,237 B2 9/2005 Smalley et al.
6,952,355 B2 10/2005 Riggio et al.
6,971,391 B1 12/2005 Wang et al.
6,979,709 B2 12/2005 Smalley et al.
6,986,876 B2 1/2006 Smalley et al.
6,998,939 B2 2/2006 Nakayama et al.
7,008,604 B2 3/2006 Smalley et al.
7,019,391 B2 3/2006 Tran
7,034,091 B2 4/2006 Schultz et al.
7,034,645 B2 4/2006 Shafer et al.
7,041,620 B2 5/2006 Smalley et al.
7,048,999 B2 5/2006 Smalley et al.
7,069,639 B2 7/2006 Choi et al.
7,071,406 B2 7/2006 Smalley et al.
7,078,999 B2 7/2006 Uriu et al.
7,081,803 B2 7/2006 Takaya et al.
7,087,207 B2 8/2006 Smalley et al.
7,091,412 B2 8/2006 Wang et al.
7,091,575 B2 8/2006 Ahn et al.
7,105,596 B2 9/2006 Smalley et al.
7,108,841 B2 9/2006 Smalley et al.
7,127,294 B1 10/2006 Wang et al.
7,142,066 B1 11/2006 Hannah et al.
7,162,302 B2 1/2007 Wang et al.
7,187,263 B2 3/2007 Vinciarelli
7,205,069 B2 4/2007 Smalley et al.
7,213,915 B2 5/2007 Tsutsumi et al.
7,221,249 B2 5/2007 Shafer et al.
7,262,482 B2 8/2007 Ahn et al.
7,263,761 B1 9/2007 Shafer et al.
7,294,366 B2 11/2007 Renn et al.
7,319,599 B2 1/2008 Hirano et al.
7,330,369 B2 2/2008 Tran
7,339,451 B2 3/2008 Liu et al.
7,345,562 B2 3/2008 Shafer et al.
7,354,563 B2 4/2008 Smalley et al.
7,375,417 B2 5/2008 Tran
7,380,328 B2 6/2008 Ahn et al.
7,390,477 B2 6/2008 Smalley et al.
7,390,767 B2 6/2008 Smalley et al.
7,393,699 B2 7/2008 Tran
7,400,512 B2 7/2008 Hirano et al.
7,419,624 B1 9/2008 Smalley et al.
7,419,651 B2 9/2008 Smalley et al.
7,442,665 B2 10/2008 Schultz et al.
7,445,852 B2 11/2008 Maruko et al.
7,449,984 B2 11/2008 Kawarai
7,481,989 B2 1/2009 Smalley et al.
7,485,366 B2 2/2009 Ma et al.
7,489,537 B2 2/2009 Tran
7,525,406 B1 4/2009 Cheng
7,567,163 B2 7/2009 Dadafshar et al.
7,791,445 B2 9/2010 Manoukian et al.
2001/0016977 A1 8/2001 Moro et al.
2001/0043135 A1 11/2001 Yamada et al.
2002/0009577 A1 1/2002 Takaya et al.
2002/0067234 A1 6/2002 Kung
2002/0121957 A1 9/2002 Takashima et al.
2003/0029830 A1 2/2003 Takaya et al.
2003/0184423 A1 10/2003 Holdahl et al.
2004/0017276 A1 1/2004 Chen et al.
2004/0174239 A1 9/2004 Shibata et al.
2004/0189430 A1 9/2004 Matsutani et al.
2004/0209120 A1 10/2004 Inoue et al.
2004/0210289 A1 10/2004 Wang et al.
2005/0007296 A1 1/2005 Endo et al.
2005/0012581 A1 1/2005 Ono et al.
2005/0151614 A1 7/2005 Dadafshar
2005/0174207 A1 8/2005 Young et al.
2005/0184848 A1 8/2005 Yoshida et al.
2005/0188529 A1 9/2005 Uriu et al.
2006/0001517 A1 1/2006 Cheng
2006/0038651 A1 2/2006 Mizushima et al.
2006/0049906 A1 3/2006 Liu et al.
2006/0145800 A1 7/2006 Dadafshar et al.
2006/0145804 A1 7/2006 Matsutani et al.
2006/0186975 A1 8/2006 Wang
2006/0186978 A1 8/2006 Kawarai
2006/0290460 A1 12/2006 Waffenschmidt et al.
2007/0030108 A1 2/2007 Ishimoto et al.
2007/0057755 A1 3/2007 Suzuki et al.
2007/0163110 A1 7/2007 Sutardja
2007/0175545 A1 8/2007 Urata et al.
2007/0252669 A1 11/2007 Hansen et al.
2008/0001702 A1 1/2008 Brunner
2008/0012679 A1 1/2008 Okabe et al.
2008/0061917 A1 3/2008 Manoukian et al.
2008/0110014 A1 5/2008 Shafer et al.

(56) References Cited

U.S. PATENT DOCUMENTS

| | | | |
|---|---|---|---|
| 2008/0278275 | A1 | 11/2008 | Fouquet et al. |
| 2008/0310051 | A1 | 12/2008 | Yan et al. |
| 2009/0058588 | A1 | 3/2009 | Suzuki et al. |
| 2009/0066454 | A1 | 3/2009 | Hansen |
| 2009/0096565 | A1 | 4/2009 | Lanni |
| 2009/0179723 | A1 | 7/2009 | Ikriannikov et al. |
| 2009/0302512 | A1 | 12/2009 | Gablenz et al. |
| 2010/0007451 | A1 | 1/2010 | Yan et al. |
| 2010/0007453 | A1 | 1/2010 | Yan et al. |
| 2010/0007457 | A1 | 1/2010 | Yan et al. |
| 2010/0013587 | A1 | 1/2010 | Yan et al. |
| 2010/0026443 | A1 | 2/2010 | Yan et al. |
| 2010/0039200 | A1 | 2/2010 | Yan et al. |
| 2010/0085139 | A1 | 4/2010 | Yan et al. |
| 2010/0171581 | A1 | 7/2010 | Manoukian et al. |
| 2010/0259351 | A1 | 10/2010 | Bogert et al. |
| 2010/0259352 | A1 | 10/2010 | Yan et al. |
| 2010/0277267 | A1 | 11/2010 | Bogert et al. |

FOREIGN PATENT DOCUMENTS

| | | | |
|---|---|---|---|
| EP | 0655754 | A1 | 5/1995 |
| EP | 0785557 | A1 | 7/1997 |
| EP | 1150312 | A2 | 10/2001 |
| EP | 1288975 | A2 | 3/2003 |
| EP | 1486991 | A1 | 12/2004 |
| EP | 1526556 | A1 | 4/2005 |
| EP | 1564761 | A1 | 8/2005 |
| EP | 1833063 | A1 | 9/2007 |
| FR | 2556493 | A1 | 6/1985 |
| GB | 2044550 | A | 10/1980 |
| JP | 60-176208 | | 9/1985 |
| JP | 6423121 | | 2/1989 |
| JP | 1266705 | | 10/1989 |
| JP | 03241711 | | 10/1991 |
| JP | 05291046 | | 5/1993 |
| JP | 06216538 | | 8/1994 |
| JP | 07272932 | | 10/1995 |
| JP | 2700713 | | 1/1998 |
| JP | 10106839 | | 4/1998 |
| JP | 2000182872 | | 6/2000 |
| JP | 3108931 | | 11/2000 |
| JP | 3160685 | | 4/2001 |
| JP | 2002043143 | | 2/2002 |
| JP | 2002280745 | | 9/2002 |
| JP | 2002313632 | | 10/2002 |
| JP | 2004200468 | | 7/2004 |
| JP | 2005129968 | | 5/2005 |
| JP | 2005-217084 | | 8/2005 |
| JP | 2007227914 | | 9/2007 |
| JP | 2008078178 | | 4/2008 |
| KR | 20010014533 | | 2/2001 |
| KR | 20020071285 | | 9/2002 |
| KR | 20030081738 | | 10/2003 |
| WO | 9205568 | | 4/1992 |
| WO | 9704469 | | 2/1997 |
| WO | 0191141 | A1 | 11/2001 |
| WO | 2005008692 | A2 | 1/2005 |
| WO | 2005020254 | A2 | 3/2005 |
| WO | 2005024862 | A1 | 3/2005 |
| WO | 2006063081 | A2 | 6/2006 |
| WO | 2008008538 | A2 | 1/2008 |
| WO | 2008152493 | A2 | 12/2008 |
| WO | 2009113775 | A2 | 9/2009 |

OTHER PUBLICATIONS

International Search Report and Written Opinion of PCT/US2011/024714; Apr. 21, 2011; 14 pages.
International Preliminary Report on Patentability of PCT/US2009/057471; Apr. 21, 2011; 6 pages.
International Search Report and Written Opinion of PCT/US2010/032803; Aug. 23, 2010; 16 pages.
International Search Report and Written Opinion of PCT/US2010/032798; Aug. 20, 2010; 15 pages.
International Search Report and Written Opinion of PCT/US2010/031886; Aug. 18, 2010; 14 pages.
International Search Report and Written Opinion of PCT/US2010/032517; Aug. 12, 2010; 16 pages.
International Search Report and Written Opinion of PCT/US2010/032414; Aug. 11, 2010; 15 pages.
International Search Report and Written Opinion of PCT/US2010/032407; Aug. 2, 2010; 19 pages.
International Search Report and Written Opinion of PCT/US2010/032992; Jul. 28, 2010; 15 pages.
International Search Report and Written Opinion of PCT/US2010/032540; Jul. 27, 2010; 20 pages.
International Search Report and Written Opinion of PCT/US2010/033006; Jul. 15, 2010; 18 pages.
International Search Report and Written Opinion of PCT/US2010/032787; Jul. 14, 2010; 20 pages.
International Search Report and Written Opinion of PCT/US2009/057471; Dec. 14, 2009; 14 pages.
International Search Report and Written Opinion of PCT/US2009/051005; Sep. 23, 2009; 15 pages.
ViISA-Literatur; http://130.149.194.207/visa-projekt/literatur.htm; Federal Ministry of Education and Research; Jan. 23, 2009. 11 pages.
VISA-Overview; http://130.149.194.207/visa-projekt/index.htm; Federal Ministry of Education and Research; Jan. 23, 2009. 1 page.
Waffenschmidt, E.; VISA-Ferrite Polymer Compounds; http://130.149.194.207/visa-projekt/technology/ferrite_polymers.htm; Federal Ministry of Education and Research; Jan. 21, 2009. 2 pages.
Waffenschmidt, E.; VISA-The Concept; http://130.149.194.207/visa-projekt/technology/concept.htm; Federal Ministry of Education and Research; Jan. 21, 2009. 2 pages.
VISA-Technology; http://130.149.194.207/visa-projekt/technology/technology.htm; Federal Ministry of Education and Research; Jan. 21, 2009. 1 page.
Kim, S. et al; Electromagnetic Shielding Properties of Soft Magnetic Powder-Polymer Composite Films for the Application to Suppress Noise in the Radio Frequency Range; www.sciencedirect.com; Journal of Magnetism and Magnetic Materials 316 (2007) 472-474, no date.
Heinrichs, F., et al.; Elements to Achieve Automotive Power; www.powersystemsdesign.com; Oct. 2004; pp. 37-40; Power Systems Design Europe, no date.
Yoshida, S., et al.; Permeability and Electromagnetic-Interference Characteristics for Fe-Si-Al Alloy Flakes-Polymer Composite; Journal of Applied Physics; Apr. 15, 1999; pp. 4636-4638; vol. 85, No. 8; American Institute of Physics.
Ferrite Polymer Composite (FPC) Film; http:// www.epcos.com/inf/80/ap/e0001000.htm; 1999 EPCOS; 8 page, no date.
Kelley, A., et al; Plastic-Iron-Powder Distributed-Air-Gap Magnetic Material; Power Electronics Specialists Conference; 1990; PESC '90 Record; 21st Annual IEEE; Jun. 11-14, 1990; pp. 25-34; San Antonio, TX.
Search and Examination Report for Singapore Patent Application No. 201008632-0; Apr. 17, 2012; 18 pages.

* cited by examiner

MINIATURE POWER INDUCTOR AND METHODS OF MANUFACTURE

CROSS REFERENCE TO RELATED APPLICATIONS

This application is a continuation in part application of U.S. patent application Ser. No. 11/519,349 filed Sep. 12, 2006, and is also a continuation in part application of U.S. patent application Ser. No. 12/181,436 Filed Jul. 9, 2008, the complete disclosures of which are hereby incorporated by reference in their entirety.

BACKGROUND OF THE INVENTION

This invention relates generally to manufacturing of electronic components including magnetic cores, and more specifically to manufacturing of surface mount electronic components having magnetic cores and conductive coil windings.

A variety of magnetic components, including but not limited to inductors and transformers, include at least one conductive winding disposed about a magnetic core. Such components may be used as power management devices in electrical systems, including but not limited to electronic devices. Advancements in electronic packaging have enabled a dramatic reduction in size of electronic devices. As such, modern handheld electronic devices are particularly slim, sometimes referred to as having a low profile or thickness.

DETAILED DESCRIPTION OF THE INVENTION

Figure 1:
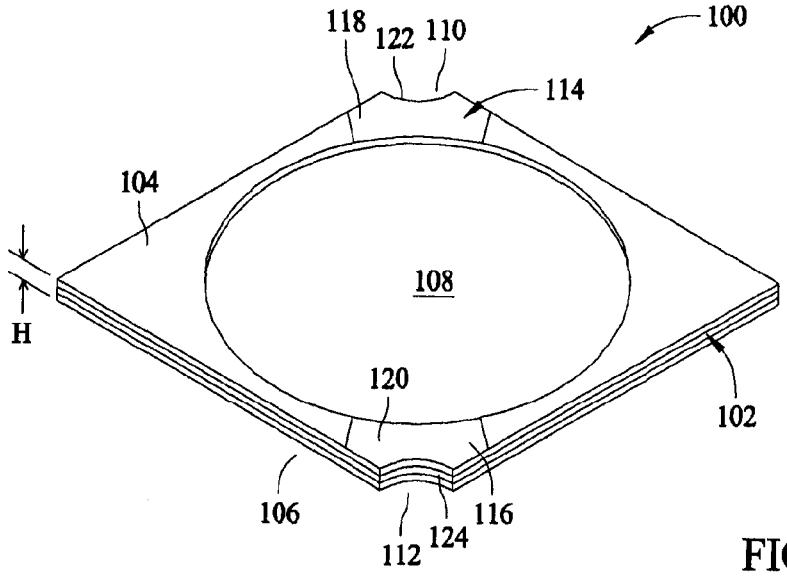
FIG. 1 is a perspective view of a magnetic component according to the present invention.

Manufacturing processes for electrical components have been scrutinized as a way to reduce costs in the highly competitive electronics manufacturing business. Reduction of manufacturing costs are particularly desirable when the components being manufactured are low cost, high volume components. In a high volume component, any reduction in manufacturing costs is, of course, significant. Manufacturing costs as used herein refers to material cost and labor costs, and reduction in manufacturing costs is beneficial to consumers and manufacturers alike. It is therefore desirable to provide a magnetic component of increased efficiency and improved manufacturability for circuit board applications without increasing the size of the components and occupying an undue amount of space on a printed circuit board.

Miniaturization of magnetic components to meet low profile spacing requirements for new products, including but not limited to hand held electronic devices such as cellular phones, personal digital assistant (PDA) devices, and other devices presents a number of challenges and difficulties. Particularly for devices having stacked circuit boards, which is now common to provide added functionality of such devices, a reduced clearance between the boards to meet the overall low profile requirements for the size of the device has imposed practical constraints that either conventional circuit board components may not satisfy at all, or that have rendered conventional techniques for manufacturing conforming devices undesirably expensive.

Such disadvantages in the art are effectively overcome by virtue of the present invention. For a full appreciation of the inventive aspects of exemplary embodiments of the invention described below, the disclosure herein will be segmented into sections, wherein Part I is an introduction to conventional magnetic components and their disadvantages; Part II discloses an exemplary embodiments of a component device according to the present invention and a method of manufacturing the same; and Part III discloses an exemplary embodiments of a modular component device according to the present invention and a method of manufacturing the same.

I. Introduction to low profile magnetic components

Conventionally, magnetic components, including but not limited to inductors and transformers, utilize a conductive winding disposed about a magnetic core. In existing components for circuit board applications, magnetic components may be fabricated with fine wire that is helically wound on a low profile magnetic core, sometimes referred to as a drum. For small cores, however, winding the wire about the drum is difficult. In an exemplary installation, a magnetic component having a low profile height of less than 0.65 mm is desired. Challenges of applying wire coils to cores of this size tends to increase manufacturing costs of the component and a lower cost solution is desired.

Efforts have been made to fabricate low profile magnetic components, sometimes referred to as chip inductors, using deposited metallization techniques on a high temperature organic dielectric substrate (e.g. FR-4, phenolic or other material) and various etching and formation techniques for forming the coils and the cores on FR4 board, ceramic substrate materials, circuit board materials, phenolic, and other rigid substrates. Such known techniques for manufacturing such chip inductors, however, involve intricate multi-step manufacturing processes and sophisticated controls. It would be desirable to reduce the complexity of such processes in certain manufacturing steps to accordingly reduce the requisite time and labor associated with such steps. It would further be desirable to eliminate some process steps altogether to reduce manufacturing costs.

II. Magnetic Devices having Integrated Coil Layers

FIG. 1 is a top plan view of a first illustrative embodiment of an magnetic component or device 100 in which the benefits of the invention are demonstrated. In an exemplary embodiment the device 100 is an inductor, although it is appreciated that the benefits of the invention described below may accrue to other types of devices. While the materials and techniques described below are believed to be particularly advantageous for the manufacture of low profile inductors, it is recognized that the inductor 100 is but one type of electrical component in which the benefits of the invention may be appreciated. Thus, the description set forth below is for illustrative purposes only, and it is contemplated that benefits of the invention accrue to other sizes and types of inductors as well as other passive electronic components, including but not limited to transformers. Therefore, there is no intention to limit practice of the inventive concepts herein solely to the illustrative embodiments described herein and illustrated in the Figures.

According to an exemplary embodiment of the invention, the inductor 100 may have a layered construction, described in detail below, that includes a coil layer 102 extending between outer dielectric layers 104, 106. A magnetic core 108 extends above, below and through a center of the coil (not shown in FIG. 1) in the manner explained below. As illustrated in FIG. 1, the inductor 100 is generally rectangular in shape, and includes opposing corner cutouts 110, 112. Surface mount terminations 114, 116 are formed adjacent the corner cutouts 110, 112, and the terminations 114, 116 each include planar termination pads 118, 120 and vertical surfaces 122, 124 that are metallized, for example, with conductive plating. When the surface mounts pads 118, 120 are connected to circuit traces on a circuit board (not shown), the metallized vertical surfaces 122, 124 establish a conductive path between the termination pads 118, 120 and the coil layer 102. The surface mount terminations 114, 116 are sometimes referred to as castellated contact terminations, although other termination structures such as contact leads (i.e. wire terminations), wrap-around terminations, dipped metallization terminations, plated terminations, solder contacts and other known connection schemes may alternatively be employed in other embodiments of the invention to provide electrical connection to conductors, terminals, contact pads, or circuit terminations of a circuit board (not shown).

In an exemplary embodiment, the inductor 100 has a low profile dimension H that is less than 0.65 mm in one example, and more specifically is about 0.15 mm. The low profile dimension H corresponds to a vertical height of the inductor 100 when mounted to the circuit board, measured in a direction perpendicular to the surface of the circuit board. In the plane of the board, the inductor 100 may be approximately square having side edges about 2.5 mm in length in one embodiment. While the inductor 100 is illustrated with a rectangular shape, sometimes referred to as a chip configuration, and also while exemplary dimensions are disclosed, it is understood that other shapes and greater or lesser dimensions may alternatively utilized in alternative embodiments of the invention.

Figure 2:
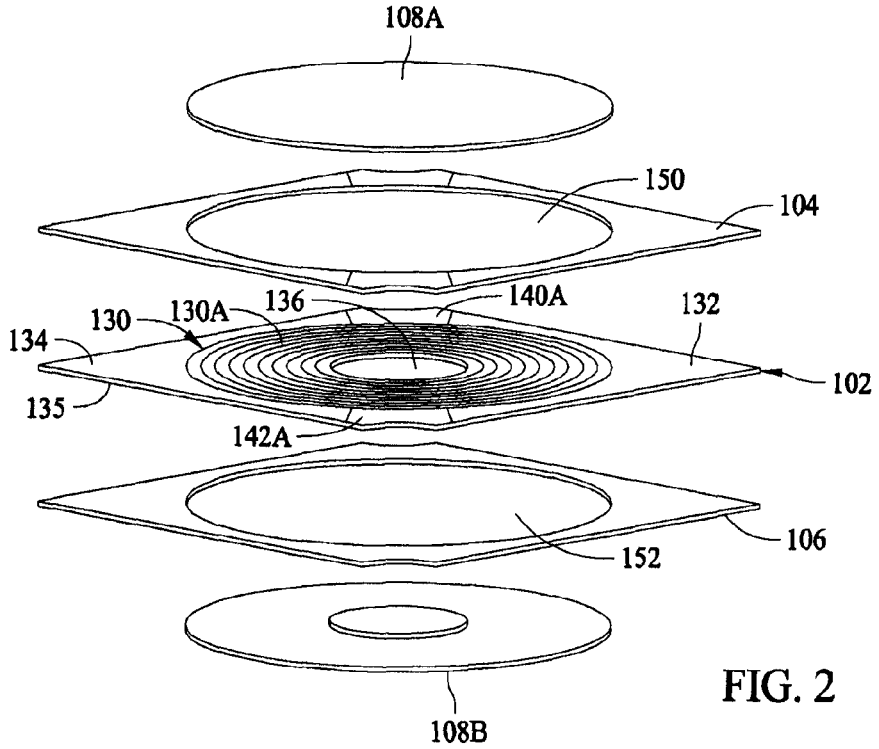
FIG. 2 is an exploded view of the device shown in FIG. 1.
Figure 3:
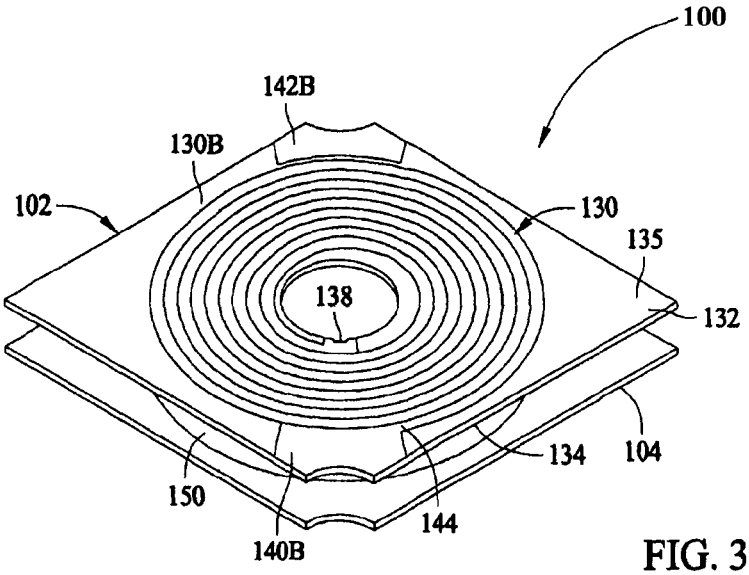
FIG. 3 is a partial exploded view of a portion of the device shown in FIG. 2.

FIG. 2 is an exploded view of the inductor 100 wherein the coil layer 102 is shown extending between the upper and lower dielectric layers 104 and 106. The coil layer 102 includes a coil winding 130 extending on a substantially planar base dielectric layer 132. The coil winding 130 includes a number of turns to achieve a desired effect, such as, for example, a desired inductance value for a selected end use application of the inductor 100. The coil winding 130 is arranged in two portions 130A and 130B on each respective opposing surface 134 (FIGS. 2) and 135 (FIG. 3) of the base layer 132. That is, a double sided coil winding 130 including portions 130A and 130B extends in the coil layer 102. Each coil winding portion 130A and 130B extends in a plane on the major surfaces 134, 135 of the base layer 132.

The coil layer 102 further includes termination pads 140A and 142A on the first surface 134 of the base layer 132, and termination pads 140B and 142B on the second surface 135 of the base layer 132. An end 144 of the coil winding portion 130B is connected to the termination pad 140B on the surface 135 (FIG. 3), and an end of the coil winding portion 130A is connected to the termination pad 142A on the surface 134 (FIG. 2). The coil winding portions 130A and 130B may be interconnected in series by a conductive via 138 (FIG. 3) at the periphery of the opening 136 in the base layer 132. Thus, when the terminations 114 and 116 are coupled to energized circuitry, a conductive path is established through the coil winding portions 130A and 130B between the terminations 114 and 116.

The base layer 132 may be generally rectangular in shape and may be formed with a central core opening 136 extending between the opposing surfaces 134 and 135 of the base layer 132. The core openings 136 may be formed in a generally circular shape as illustrated, although it is understood that the opening need not be circular in other embodiments. The core opening 136 receives a magnetic material described below to form a magnetic core structure for the coil winding portions 130A and 130B.

The coil portions 130A and 130B extends around the perimeter of the core opening 136 and with each successive turn of the coil winding 130 in each coil winding portion 130A and 130B, the conductive path established in the coil layer 102 extends at an increasing radius from the center of the opening 136. In an exemplary embodiment, the coil winding 130 extends on the base layer 132 for a number of turns in a winding conductive path atop the base layer 132 on the surface 134 in the coil winding portion 130A, and also extends for a number of turns below the base layer 132 on the surface 135 in the coil winding portion 130B. The coil winding 130 may extend on each of the opposing major surfaces 134 and 135 of the base layer 132 for a specified number of turns, such as ten turns on each side of the base layer 132 (resulting in twenty total turns for the series connected coil portions 130A and 130B). In an illustrative embodiment, a twenty turn coil winding 130 produces an inductance value of about 4 to 5 μH, rendering the inductor 100 well suited as a power inductor for low power applications. The coil winding 130 may alternatively be fabricated with any number of turns to customize the coil for a particular application or end use.

As those in the art will appreciate, an inductance value of the inductor 100 depends primarily upon a number of turns of wire in the coil winding 130, the material used to fabricate the coil winding 130, and the manner in which the coil turns are distributed on the base layer 132 (i.e., the cross sectional area of the turns in the coil winding portions 130A and 130B). As such, inductance ratings of the inductor 100 may be varied considerably for different applications by varying the number of coil turns, the arrangement of the turns, and the cross sectional area of the coil turns. Thus, while ten turns in the coil winding portions 130A and 130B are illustrated, more or less turns may be utilized to produce inductors having inductance values of greater or less than 4 to 5 μH as desired. Additionally, while a double sided coil is illustrated, it is understood that a single sided coil that extends on only one of the base layer surfaces 134 or 135 may likewise be utilized in an alternative embodiment.

The coil winding 130 may be, for example, an electroformed metal foil which is fabricated and formed independently from the upper and lower dielectric layers 104 and 106. Specifically, in an illustrative embodiment, the coil portions 130A and 130B extending on each of the major surfaces 134, 135 of the base layer 132 may be fabricated according to a known additive process, such as an electro-forming process wherein the desired shape and number of turns of the coil winding 130 is plated up, and a negative image is cast on a photo-resist coated base layer 132. A thin layer of metal, such as copper, nickel, zinc, tin, aluminum, silver, alloys thereof (e.g., copper/tin, silver/tin, and copper/silver alloys) may be subsequently plated onto the negative image cast on the base layer 132 to simultaneously form both coil portions 130A and 130B. Various metallic materials, conductive compositions, and alloys may be used to form the coil winding 130 in various embodiments of the invention.

Separate and independent formation of the coil winding 130 from the dielectric layers 104 and 106 is advantageous in comparison to known constructions of chip inductors, for example, that utilize metal deposition techniques on inorganic substrates and subsequently remove or subtract the deposited metal via etching processes and the like to form a coil structure. For example, separate and independent formation of the coil winding 130 permits greater accuracy in the control and position of the coil winding 130 with respect to the dielectric layers 104, 106 when the inductor 100 is constructed. In comparison to etching processes of known such devices, independent formation of the coil winding 130 also permits greater control over the shape of the conductive path of the coil. While etching tends to produce oblique or sloped side edges of the conductive path once formed, substantially perpendicular side edges are possible with electroforming processes, therefore providing a more repeatable performance in the operating characteristics of the inductor 100. Still further, multiple metals or metal alloys may be used in the separate and independent formation process, also to vary performance characteristics of the device.

While electroforming of the coil winding 130 in a pre-fabricated manner separate and distinct from the dielectric layers 104 and 106 is believed to be advantageous, it is understood that the coil winding 130 may be alternatively formed by other methods while still obtaining some of the advantages of the present invention. For example, the coil winding 130 may be an electro deposited metal foil applied to the base layer 132 according to known techniques. Other additive techniques such as screen printing and deposition techniques may also be utilized, and subtractive techniques such as chemical etching, plasma etching, laser trimming and the like as known in the art may be utilized to shape the coils. Alternatively, the pre-fabricated coil winding need not be fabricated and formed on any pre-existing substrate material at all, but rather may be a flexible wire conductor that is wound around a winding axis to form a self-supporting, freestanding coil structure that is assembled with the various dielectric layers of the component.

The upper and lower dielectric layers 104, 106 overlie and underlie, respectively, the coil layer 102. That is, the coil layer 102 extends between and is intimate contact with the upper and lower dielectric layers 104, 106. In an exemplary embodiment, the upper and lower dielectric layers 104 and 106 sandwich the coil layer 102, and each of the upper and lower dielectric layers 104 and 106 include a central core opening 150, 152 formed therethrough. The core openings 150, 152 may be formed in generally circular shapes as illustrated, although it is understood that the openings need not be circular in other embodiments.

The openings 150, 152 in the respective first and second dielectric layers 104 and 106 expose the coil portions 130A and 130B and respectively define a receptacle above and below the double side coil layer 102 where the coil portions 130A and 130B extend for the introduction of a magnetic material to form the magnetic core 108. That is, the openings 150, 152 provide a confined location for portions 108A and 108B of the magnetic core.

Figure 4:
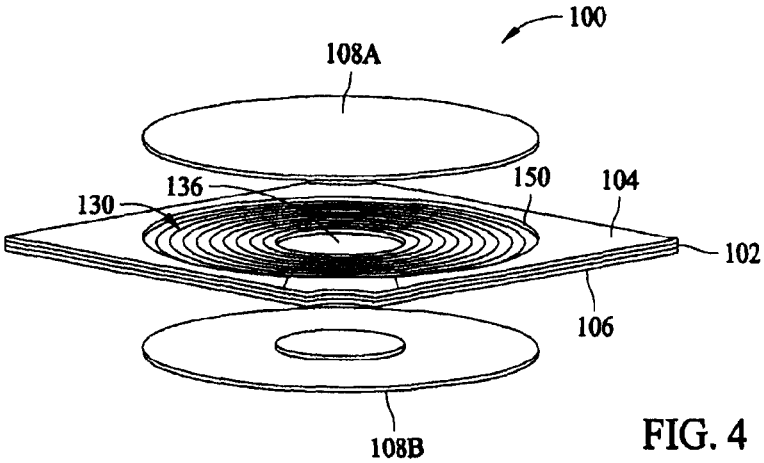
FIG. 4 is another exploded view of the device shown in FIG. 1 in a partly assembled condition.

FIG. 4 illustrates the coil layer 102 and the dielectric layers 104 and 106 in a stacked relation. The layers 102, 104, 106 may be secured to one another in a known manner, such as with a lamination process. As shown in FIG. 4, the coil winding 130 is exposed within the core openings 150 and 152 (FIG. 2), and the core pieces 108A and 108B may be applied to the openings 150, 152 and the opening 136 in the coil layer 102.

In an exemplary embodiment, the core portions 108A and 108B are applied as a powder or slurry material to fill the openings 150 and 152 in the upper and lower dielectric layers 104 and 106, and also the core opening 136 (FIGS. 2 and 3) in the coil layer 102. When the core openings 136, 150 and 152 are filled, the magnetic material surrounds or encases the coil portions 130A and 130B. When cured, core portions 108A and 108B form a monolithic core piece and the coil portions 130A and 130B are embedded in the core 108, and the core pieces 108A and 108B are flush mounted with the upper and lower dielectric layers 104 and 106. That is, the core pieces 108A and 108B have a combined height extending through the openings that is approximately the sum of the thicknesses of the layers 104, 106 and 132. In other words, the core pieces 108A and 108B also satisfy the low profile dimension H (FIG. 1). The core 108 may be fabricated from a known magnetic permeable material, such as a ferrite or iron powder in one embodiment, although other materials having magnetic permeability may likewise be employed.

In an illustrative embodiment, the first and second dielectric layers 104 and 106, and the base layer 132 of the coil layer 102 are each fabricated from polymer based dielectric films. The upper and lower insulating layers 104 and 106 may include an adhesive film to secure the layers to one another and to the coil layer 102. Polymer based dielectric films are advantageous for their heat flow characteristics in the layered construction. Heat flow within the inductor 100 is proportional to the thermal conductivity of the materials used, and heat flow may result in power losses in the inductor 100. Thermal conductivity of some exemplary known materials are set forth in the following Table, and it may be seen that by reducing the conductivity of the insulating layers employed, heat flow within the inductor 100 may be considerably reduced. Of particular note is the significantly lower thermal conductivity of polyimide, which may be employed in illustrative embodiments of the invention as insulating material in the layers 104, 106 and 132.

| Substrate Thermal Conductivity's (W/mK) | |
|---|---|
| Alumina ($Al_2O_3$) | 19 |
| Forsterite ($2MgO—SiO_2$) | 7 |
| Cordierite ($2MgO—2Al_2O_3—5SiO_2$) | 1.3 |
| Steatite ($2MgO—SiO_2$) | 3 |
| Polyimide | 0.12 |
| FR-4 Epoxy Resin/Fiberglass Laminate | 0.293 |

One such polyimide film that is suitable for the layers 104, 106 and 132 is commercially available and sold under the trademark KAPTON® from E. I. du Pont de Nemours and Company of Wilmington, Del. It is appreciated, however, that in alternative embodiments, other suitable electrical insulation materials (polyimide and non-polyimide) such as CIRLEX® adhesiveless polyimide lamination materials, UPILEX® polyimide materials commercially available from Ube Industries, Pyrolux, polyethylene naphthalendicarboxylate (sometimes referred to as PEN), Zyvrex liquid crystal polymer material commercially available from Rogers Corporation, and the like may be employed in lieu of KAPTON®. It is also recognized that adhesiveless materials may be employed in the first and second dielectric layers 104 and 106. Pre-metallized polyimide films and polymer-based films are also available that include, for example, copper foils and films and the like, that may be shaped to form specific circuitry, such as the winding portions and the termination pads, for example, of the coil layers, via a known etching process, for example.

Polymer based films also provide for manufacturing advantages in that they are available in very small thicknesses, on the order of microns, and by stacking the layers a very low profile inductor 100 may result. The layers 104, 106 and 132 may be adhesively laminated together in a straightforward manner, and adhesiveless lamination techniques may alternatively be employed.

Figure 5:
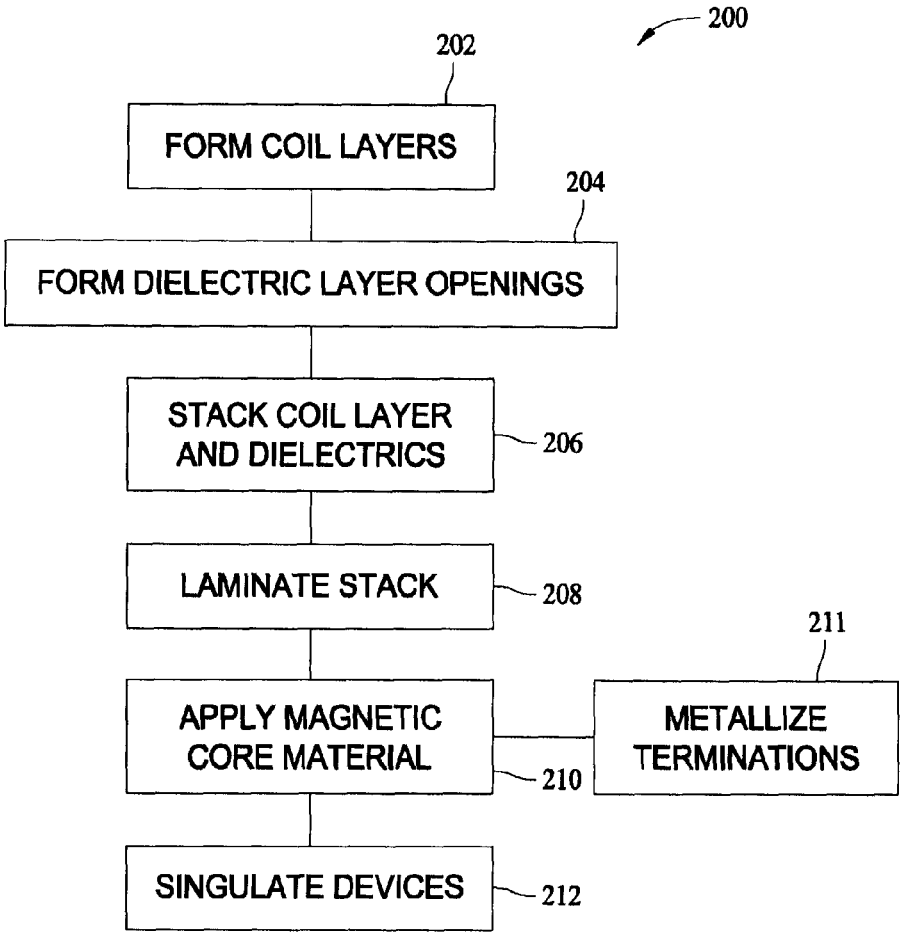
FIG. 5 is a method flowchart of a method of manufacturing the component shown in FIGS. 1-4.

The construction of the inductor also lends itself to subassemblies that may be separately provided and assembled to one another according the following method 200 illustrated in FIG. 5.

The coil windings 130 may be formed 202 in bulk on a larger piece or sheet of a dielectric base layer 132 to form 202 the coil layers 102 on a larger sheet of dielectric material. The windings 130 may be formed in any manner described above, or via other techniques known in the art. The core openings 136 may be formed in the coil layers 102 before or after forming of the coil windings 130. The coil windings 130 may be double sided or single sided as desired, and may be formed with additive electro-formation techniques or subtractive techniques for defining a metallized surface. The coil winding portions 130A and 130B, together with the termination pads 140, 142 and any interconnections 138 (FIG. 3) are provided on the base layer 132 to form 202 the coil layers 102 in an exemplary embodiment.

The dielectric layers 104 and 106 may likewise be formed 204 from larger pieces or sheets of dielectric material, respectively. The core openings 150, 152 in the dielectric layers may be formed in any known manner, including but not limited to punching techniques, and in an exemplary embodiment, the core openings 150, 152 are formed prior to assembly of the layers 104 and 106 on the coil layer.

The sheets including the coil layers 102 from step 202 and the sheets including the dielectric layers 104, 106 formed in step 204 may then be stacked 206 and laminated 208 to form an assembly as shown in FIG. 4. After stacking 206 and/or laminating 208 the sheets forming the respective coil layers 102 and dielectric layers 104 and 106, the magnetic core material may be applied 210 in the pre-formed core openings 136, 150 and 152 in the respective layers to form the cores. After curing the magnetic material, the layered sheets may be cut, diced, or otherwise singulated 212 into individual magnetic components 100. Vertical surfaces 122, 124 of the terminations 114, 116 (FIG. 1) may be metallized 211 via, for example, a plating process, to interconnect the termination pads 140, 142 of the coil layers 102 (FIGS. 2 and 3) to the termination pads 118, 120 (FIG. 1) of the dielectric layer 104.

With the above-described layered construction and methodology, magnetic components such as inductors may be provided quickly and efficiently, while still retaining a high degree of control and reliability over the finished product. By pre-forming the coil layers and the dielectric layers, greater accuracy in the formation of the coils and quicker assembly results in comparison to known methods of manufacture. By forming the core over the coils in the core openings once the layers are assembled, separately provided core structures, and manufacturing time and expense, is avoided. By embedding the coils into the core, separately applying a winding to the surface of the core in conventional component constructions is also avoided. Low profile inductor components may therefore be manufactured at lower cost and with less difficulty than known methods for manufacturing magnetic devices.

It is contemplated that greater or fewer layers may be fabricated and assembled into the component 100 without departing from the basic methodology described above. Using the above described methodology, magnetic components for inductors and the like may be efficiently formed using low cost, widely available materials in a batch process using relatively inexpensive techniques and processes. Additionally, the methodology provides greater process control in fewer manufacturing steps than conventional component constructions. As such, higher manufacturing yields may be obtained at a lower cost.

Figure 6A:
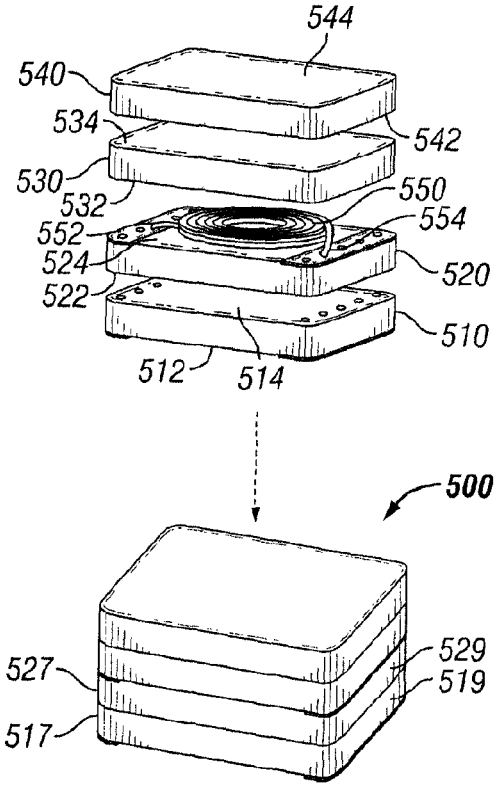
FIG. 6A illustrates a perspective view and an exploded view of the top side of a miniature power inductor having a preformed coil and at least one magnetic powder sheet in accordance with an exemplary embodiment.
Figure 6B:
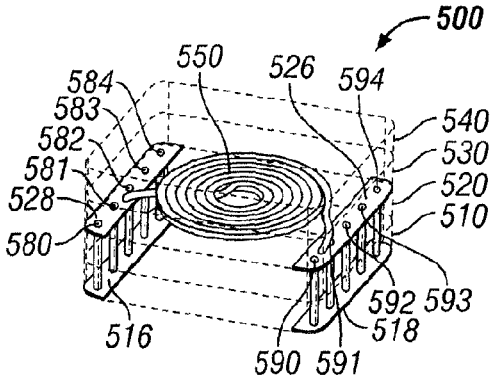
FIG. 6B illustrates a perspective transparent view of the miniature power inductor as depicted in FIG. 6A in accordance with an exemplary embodiment.

FIGS. 6A and 6B illustrate another embodiment of a magnetic component 500 that is also fabricated from flexible sheet materials using relatively low cost pressure lamination processes. Unlike the embodiments described above, the sheet materials are magnetic in addition to being dielectric. That is, the sheet materials in the component 500 exhibit a relative magnetic permeability $\mu_r$ of greater than 1.0 and are generally considered to be magnetically responsive materials, while still being dielectric or electrically non-conductive materials. In exemplary embodiments the relative magnetic permeability $\mu_r$ may be much greater than one to produce sufficient inductance for a miniature power inductor, and in an exemplary embodiment the magnetic permeability $\mu_r$ may be at least 10.0 or more.

With the sheet materials being both dielectric and magnetic in the component 500, the magnetic performance of the component 500 can be enhanced considerably. Further, in some embodiments, the separately provided magnetic core 108 in the component 100 (FIGS. 1-4), and the associated manufacturing steps associated with it, including but not limited to the formation of the core openings 150, 152 may be avoided and costs may be saved. In other embodiments, it is contemplated that a separately provided magnetic core material filling the open center area of the coil winding may be desirable for power inductor applications, particularly a magnetic core material having a much higher relative magnetic permeability than the sheets themselves may provide.

Referring to FIGS. 6A and 6B, several views of another illustrative embodiment of a magnetic component or device 500 are shown. FIG. 6A illustrates a perspective view and an exploded view of the top side of a miniature power inductor having a pre-formed or pre-fabricated coil and at least one magnetic powder sheet in accordance with an exemplary embodiment. FIG. 6B illustrates a perspective transparent view of the miniature power inductor as depicted in FIG. 6A in accordance with an exemplary embodiment.

As shown in the Figures, the miniature power inductor 500 includes at least one flexible magnetic powder sheet 510, 520, 530, 540 and at least one preformed or pre-fabricated coil 550 assembled with and coupled to the at least one magnetic powder sheet 510, 520, 530, 540. The coil 550 is, as shown in FIGS. 6A and 6B, a flexible wire conductor that is wound around a winding axis to form a self-supporting, freestanding coil structure in one embodiment. The coil winding 550 is wound into a compact and generally low profile spiral configuration including a number of curvilinear wire turns extending around an open center area. Distal ends of leads of the wire used to fabricate the coil winding 550 also extend from the outer periphery of the curvilinear spiral winding.

As seen in the illustrated embodiment, the miniature power inductor 500 comprises a first magnetic powder sheet 510 having a lower surface 512 and an upper surface 514, a second magnetic powder sheet 520 having a lower surface 522 and an upper surface 524, a third magnetic powder sheet 530 having a lower surface 532 and an upper surface 534, and a fourth magnetic powder sheet 540 having a lower surface 542 and an upper surface 544. In an exemplary embodiment, the flexible magnetic powder sheets can be magnetic powder sheets manufactured by Chang Sung Incorporated in Incheon, Korea and sold under product number 20u-eff Flexible Magnetic Sheet. Such sheets, as those in the art may recognize, are high-density soft magnetic Fe—Al—Si alloy-polymer composite films that are provided in self supporting or freestanding solid form, as opposed to liquid or semisolid form such as slurrys. The magnetic-polymer composite films may also be recognized as having distributed gap properties as those in the art would no doubt appreciate.

More specifically, in the exemplary magnetic powder sheets available from Chang Sung, plate-like Fe—Al—Si soft magnetic powders having thickness of 2-3 mm and a large aspect ratio are produced by mechanical attrition of the alloy granule powders. Attrition of the granule powders is then carried out in a hydrocarbon solvent, i.e., toluene by using an attrition mill. The plate-like powders and a thermoplastic resin such as chlorinated polyethylene are mixed in an agate mortar. A weight ratio of powder mixture and binder are kept constant at a ratio of 80:20. The magnetic mixtures containing the plate-like powders and polymer binder are then roll-pressed in a 2-roll press and soft magnetic metal-polymer films are fabricated. The resultant magnetic films consist of polymer binder and the soft magnetic plate-like powders oriented with their long axis parallel to the basal plane of film. Such sheets are known and have been made available by Chang Sung for use in electromagnetic interferences (EMI) shielding applications of electrical components.

Although the exemplary embodiment shown in FIGS. 6A and 6B includes four magnetic powder sheets, the number of magnetic powder sheets may be increased or reduced so as to increase or decrease the core area without departing from the scope and spirit of the exemplary embodiment. Also, while specific magnetic powder sheets have been described, other flexible sheets may be used that are capable of being laminated, without departing from the scope and spirit of the exemplary embodiment. Moreover, although this embodiment depicts the use of one preformed coil, additional preformed coils may be used with the addition of more magnetic powder sheets by altering one or more of the terminations so that the more than one preformed coils may be positioned in parallel or in series, without departing from the scope and spirit of the exemplary embodiment.

The first magnetic powder sheet 510 also includes a first terminal 516 and a second terminal 518 coupled to opposing longitudinal sides of the lower surface 512 of the first magnetic powder sheet 510. According to this embodiment, the terminals 516, 518 extend the entire length of the longitudinal side. Although this embodiment depicts the terminals extending along the entire opposing longitudinal sides, the terminals may extend only a portion of the opposing longitudinal sides without departing from the scope and spirit of the exemplary embodiment. Additionally, these terminals 516, 518 may be used to couple the miniature power inductor 500 to an electrical circuit, which may be on a printed circuit board (not shown), for example.

The second magnetic powder sheet 520 also includes a third terminal 526 and a fourth terminal 528 coupled to opposing longitudinal sides of the lower surface 522 of the second magnetic powder sheet 520. According to this embodiment, the terminals 526, 528 extend the entire length of the longitudinal side, similar to the terminals 516, 518 of the first magnetic powder sheet 510. Although this embodiment depicts the terminals extending along the entire opposing longitudinal sides, the terminals may extend only a portion of the opposing longitudinal sides without departing from the scope and spirit of the exemplary embodiment. Additionally, these terminals 526, 528 may be used to couple the first terminal 516 and the second terminal 518 to the at least one preformed coil 550.

The terminals 516, 518, 526, 528 may be formed by any of the methods described above, which includes, but is not limited to, a stamped copper foil or etched copper trace. Alternatively, other known terminals known in the art may be utilized and electrically connected to the respective ends of the coil winding 550.

Each of the first magnetic powder sheet 510 and the second magnetic powder sheet 520 further include a plurality of vias 580, 581, 582, 583, 584, 590, 591, 592, 593, 594 extending from the upper surface 524 of the second magnetic powder sheet 520 to the lower surface 512 of the first magnetic powder sheet 510. As shown in this embodiment, these plurality of vias 580, 581, 582, 583, 584, 590, 591, 592, 593, 594 are positioned on the terminals 516, 518, 526, 528 in a substantially linear pattern. There are five vias positioned along one of the edges of the first magnetic powder sheet 510 and the second magnetic powder sheet 520, and there are five vias positioned along the opposing edge of the first magnetic powder sheet 510 and the second magnetic powder sheet 520. Although five vias are shown along each of the opposing longitudinal edges, there may be greater or fewer vias without departing from the scope and spirit of the exemplary embodiment. Additionally, although vias are used to couple first and second terminals 516, 518 to third and fourth terminals 526, 528, alternative coupling may be used without departing from the scope and spirit of the exemplary embodiment. One such alternative coupling includes, but is not limited to, metal plating along at least a portion of the opposing side faces 517, 519, 527, 529 of both first magnetic powder sheet 510 and second magnetic powder sheet 520 and extending from the first and second terminals 516, 518 to the third and fourth terminals 526, 528. Also, in some embodiments, the alternative coupling may include metal plating that extends the entire opposing side faces 517, 519, 527, 529 and also wraps around the opposing side faces 517, 519, 527, 529. According to some embodiments, alternative coupling, such as the metal plating of the opposing side faces, may be used in addition to or in lieu of the vias; or alternatively, the vias may be used in addition to or in lieu of the alternative coupling, such as metal plating of the opposing side faces.

Upon forming the first magnetic powder sheet 510 and the second magnetic powder sheet 520, the first magnetic powder sheet 510 and the second magnetic powder sheet 520 are pressed together with high pressure, for example, hydraulic pressure, and laminated together to form a portion of the miniature power inductor 500. As used herein, the term "laminated" shall refer to a process wherein the magnetic powder sheets are joined or united as layers, and remain as identifiable layers after being joined and united. Also, the thermoplastic resins in the magnetic sheets as described allow for pressure lamination of the powder sheets without heating during the lamination process. Expenses and costs associated with elevated temperatures of heat lamination, that are required by other known materials, are therefore obviated in favor of pressure lamination. The magnetic sheets may be placed in a mold or other pressure vessel, and compressed to laminate the magnetic powder sheets to one another.

After sheets 510, 520 have been pressed together, the vias 580, 581, 582, 583, 584, 590, 591, 592, 593, 594 are formed, in accordance to the description provided for FIGS. 6A-6B. In place of forming the vias, other terminations may be made between the two sheets 510, 520 without departing from the scope and spirit of the exemplary embodiment. Once the first magnetic powder sheet 510 and the second magnetic powder sheet 520 are pressed together, the preformed winding or coil 550 having a first lead 552 and a second lead 554 may be positioned on the upper surface 524 of the second magnetic powder sheet 520, where the first lead 552 is coupled to either the third terminal 526 or the fourth terminal 528 and the second lead is coupled to the other terminal 526, 528. The preformed winding 550 may be coupled to the terminals 526, 528 via soldering, welding or other known coupling methods. The third magnetic powder sheet 530 and the fourth magnetic powder sheet 540 may then be laminated to the previously pressed portion of the miniature power inductor 500 to form the completed miniature power inductor 500. According to this embodiment, the layers flex over and around the outer surface of the coil winding 550 such that a physical gap between the winding and the core, which is typically found in conventional inductors, is not formed. The elimination of this physical gap tends to minimize the audible noise from the vibration of the winding.

Although there are no magnetic sheets shown between the first and second magnetic powder sheets, magnetic sheets may positioned between the first and second magnetic powder sheets so long as there remains an electrical connection between the terminals of the first and second magnetic powder sheets without departing from the scope and spirit of the exemplary embodiment. Additionally, although two magnetic powder sheets are shown to be positioned above the preformed coil, greater or fewer sheets may be used to increase or decrease the core area for the winding 550 without departing from the scope and spirit of the exemplary embodiment. It is also contemplated that a single sheet, such as the third sheet 530 may be laminated to the coil 102 in certain embodiments without utilizing the lower sheet 106 or any other sheet.

In this embodiment, the magnetic field produced by the coil winding 550 may be created in a direction that is perpendicular to a dominant direction of the magnetic grain orientation of the magnetic sheets and thereby achieve a lower inductance, or the magnetic field may be created in a direction that is parallel to the dominant direction of magnetic grain orientation in the magnetic sheets, thereby achieving a comparatively higher inductance. Higher and lower inductances are therefore possible to meet different needs with strategic selection of the dominant direction of the magnetic grains in the magnetic powder sheets, which may in turn depend on how the magnetic sheets are extruded as they are fabricated.

The miniature power inductor 500 is depicted as a rectangular shape. However, other geometrical shapes, including but not limited to square, circular, or elliptical shapes, may alternatively be used without departing from the scope and spirit of the exemplary embodiment.

Various formulations of the magnetic sheets are possible to achieve varying levels of magnetic performance of the component or device in use. In general, however, in a power inductor application, the magnetic performance of the material is generally proportional to the flux density saturation point (Bsat) of the magnetic particles used in the sheets, the permeability (μ) of the magnetic particles, the loading (% by weight) of the magnetic particles in the sheets, and the bulk density of the sheets after being pressed as explained below. That is, by increasing the magnetic saturation point, the permeability, the loading and the bulk density a higher inductance will be realized and performance will be improved.

On the other hand, the magnetic performance of the component is inversely proportional to the amount of binder material used in the magnetic sheets. Thus, as the loading of the binder material is increased, the inductance value of the end component tends to decrease, as well as the overall magnetic performance of the component. Each of Bsat and μ are material properties associated with the magnetic particles and may vary among different types of particles, while the loading of the magnetic particles and the loading of the binder may be varied among different formulations of the sheets.

For inductor components, the considerations above can be utilized to strategically select materials and sheet formulations to achieve specific objectives. As one example, metal powder materials may be preferred over ferrite materials for use as the magnetic powder materials in higher power indicator applications because metal powders, such as Fe—Si particles have a higher Bsat value. The Bsat value refers the maximum flux density B in a magnetic material attainable by an application of an external magnetic field intensity H. A magnetization curve, sometimes referred to as a B-H curve wherein a flux density B is plotted against a range of magnetic field intensity H may reveal the Bsat value for any given material. The initial part of the B-H curve defines the permeability or propensity of the material to become magnetized. Bsat refers to the point in the B-H curve where a maximum state of magnetization or flux of the material is established, such that the magnetic flux stays more or less constant even if the magnetic field intensity continues to increase. In other words, the point where the B-H curve reaches and maintains a minimum slope represents the flux density saturation point (Bsat).

Additionally, metal powder particles, such as Fe—Si particles have a relatively high level of permeability, whereas ferrite materials such as FeNi (permalloy) have a relatively low permeability. Generally speaking, a higher permeability slope in the B-H curve of the metal particles used, the greater the ability of the magnetic material to store magnetic flux and energy at a specified current level, which induces the magnetic field generating the flux.

III. Conclusion

The benefits and advantages of the invention are now believed to be amply illustrated by the example embodiments disclosed.

An exemplary embodiment of magnetic component has been disclosed having a laminated structure including: a coil winding comprising a first end, a second end, and a winding portion extending between the first and second ends and completing a number of turns; and a plurality of stacked dielectric material layers pressed to and joined with one another, the stacked dielectric material layers surrounding the winding portion of the coil winding. The coil winding is separately fabricated from all of the plurality of stacked dielectric layers, and terminations are coupled to the first and second ends of the coil winding for establishing surface mount circuit connections to the coil winding.

Optionally, the dielectric sheets may comprise a flexible composite film. The composite film material may comprise a thermoplastic resin and a magnetic powder. The magnetic powder may include soft magnetic particles. The composite film comprises a polyimide material.

The plurality of stacked dielectric layers may also comprise flexible magnetic powder sheets. The magnetic powder sheets may comprise magnetic-polymer composite film. The composite film may comprise soft magnetic powder mixed with a thermoplastic resin. The flexible magnetic powder sheets are stackable as a solid material, and may have a relative magnetic permeability of at about 10.0 or more. The flexible magnetic powder sheets may be pressed around outer surfaces of the coil winding, wherein the flexible magnetic powder sheets are flexed around the coil without creating a physical gap between the flexible magnetic powder sheets and the coil.

The coil winding may include a flexible wire conductor wound into a freestanding, self supporting structure. The coil winding may define an open center area, and a magnetic material may occupy the open center area. The magnetic material may be separately provided from the stacked dielectric layers. The magnetic material may be integrally provided with the stacked dielectric material layers.

The plurality of stacked dielectric material layers may be laminated with pressure but not heat. The surface mount terminations may be formed on at least one of the stacked dielectric material layers. The component may be a miniature power inductor.

An exemplary method of manufacturing a magnetic component is also disclosed. The component includes a coil winding and a core structure therefore. The coil winding has a first end, a second end, and a winding portion extending between the first and second ends and completing a number of turns. The core structure includes a plurality of dielectric material layers. The method includes: obtaining a plurality of pre-fabricated dielectric material layers; obtaining at least one pre-fabricated coil winding; coupling the at least one pre-fabricated coil winding to the plurality of pre-fabricated dielectric material layers via a pressure lamination process; and providing terminations for establishing surface mount circuit connections to first and second ends of the coil winding.

Optionally, the pressure lamination process does not include a heat lamination process. The coil winding may include an open center, with the method further including: obtaining a pre-fabricated magnetic core material; and filling the open center with the pre-fabricated magnetic core material.

A product may also be obtained by the method. In the product, the dielectric material layers may include thermoplastic resin. The dielectric material layers may further include magnetic powder. The dielectric material layers may have a relative magnetic permeability of at least about 10. The product may be a miniature power inductor.

An embodiment of a magnetic component is also disclosed comprising: a laminated structure comprising: a coil winding comprising a first end, a second end, and a winding portion extending between the first and second ends and completing a number of turns; and at least one dielectric material layer pressed to and joined with the coil layer, whereby the at least one dielectric material layer surrounds the winding portion of the coil winding; wherein the coil winding is separately fabricated from the at least one dielectric layer; and terminations coupled to the first and second ends of the coil winding for establishing surface mount circuit connections to the coil winding. The at least one dielectric material layer may include a plurality of dielectric material layers pressed to and joined with one another, or alternatively may be a single layer.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A magnetic component comprising:

a laminated structure comprising:

a coil winding comprising a first end, a second end, and a winding portion extending between the first and second ends and completing a number of turns; and a plurality of pre-formed dielectric material layers assembled in a stack, each of the plurality of pre-formed dielectric material layers being fabricated from the same material having the same properties, each of the plurality of pre-formed dielectric material layers being pressed to and joined in surface contact with one another, the assembled pre-formed dielectric material layers surrounding the winding portion of the coil winding;

wherein the coil winding is separately and independently formed from all of the plurality of pre-formed dielectric material layers; and terminations coupled to the first and second ends of the coil winding for establishing surface mount circuit connections to the coil winding.

2. The magnetic component of claim 1, wherein the plurality of pre-formed dielectric material layers each comprises a flexible composite film.

3. The magnetic component of claim 2, wherein the composite film comprises a thermoplastic resin.

4. The magnetic component of claim 3, wherein the composite film comprises magnetic powder.

5. The magnetic component of claim 4, wherein the magnetic powder comprises soft magnetic particles.

6. The magnetic component of claim 2, wherein the composite film comprises a polyimide material.

7. The magnetic component of claim 1, wherein each of the plurality of pre-formed dielectric material layers comprises a flexible magnetic powder sheet, and at least one of the plurality of flexible magnetic powder sheets is in surface contact with the coil winding.

8. The magnetic component of claim 7, wherein each of the flexible magnetic powder sheets comprises a magnetic-polymer composite film.

9. The magnetic component of claim 8, wherein the magnetic-polymer composite film comprises soft magnetic powder mixed with a thermoplastic resin.

10. The magnetic component of claim 9, wherein the flexible magnetic powder sheets are stackable as a solid material.

11. The magnetic component of claim 10, wherein the flexible magnetic powder sheets have a relative magnetic permeability of at about 10.0 or more.

12. The magnetic component of claim 7, wherein the at least one of the flexible magnetic powder sheets is pressed around an outer surface of the coil winding, and wherein the at least one of the flexible magnetic powder sheets is flexed around the coil winding without creating a physical gap between the at least one of the flexible magnetic powder sheets and the coil winding.

13. The magnetic component of claim 1, wherein the coil winding comprises a flexible wire conductor wound into a freestanding, self supporting structure.

14. The magnetic component of claim 1, wherein the coil winding defines an open center area, and a magnetic material occupies the open center area.

15. The magnetic component of claim 14, wherein the magnetic material is separately provided from the pre-formed dielectric material layers.

16. The magnetic component of claim 14, wherein the magnetic material is integrally provided with the pre-formed dielectric material layers.

17. The magnetic component of claim 1, wherein the plurality of pre-formed dielectric material layers are laminated with pressure but not heat.

18. The magnetic component of claim 1, wherein the surface mount terminations are formed on at least one of the pre-formed dielectric material layers.

19. The magnetic component of claim 1, wherein the component is a power inductor.

20. A magnetic component comprising:

a coil winding comprising a first end, a second end, and a winding portion extending between the first and second ends and completing a number of turns; and at least one pre-formed dielectric material layer pressed to and joined with the coil winding portion, whereby the at least one dielectric material layer surrounds the winding portion of the coil winding;

wherein the coil winding is separately and independently formed from the at least one dielectric material layer;

terminations coupled to the first and second ends of the coil winding for establishing surface mount circuit connections to the coil winding portion.

21. The magnetic component of claim 20, wherein the at least one dielectric material layer comprises a plurality of pre-formed dielectric material layers pressed to and joined in surface contact with one another.

22. The magnetic component of claim 21, wherein the plurality of pre-formed dielectric materials are fabricated from the same material having the same properties.

* * * * *